US012066193B2

(12) United States Patent
Adam et al.

(10) Patent No.: US 12,066,193 B2
(45) Date of Patent: Aug. 20, 2024

(54) METHOD FOR PREPARING A COOKING PRODUCT, COOKING DEVICE, AND COOKING DEVICE SYSTEM

(71) Applicant: BSH Hausgeräte GmbH, Munich (DE)

(72) Inventors: Julien Adam, Lingolsheim (FR); Victorien Bierg, Schiltigheim (FR); Flavien Martos, Strasbourg (FR)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/058,679

(22) PCT Filed: Oct. 8, 2019

(86) PCT No.: PCT/EP2019/077164
§ 371 (c)(1),
(2) Date: Nov. 25, 2020

(87) PCT Pub. No.: WO2020/074478
PCT Pub. Date: Apr. 16, 2020

(65) Prior Publication Data

US 2021/0207811 A1 Jul. 8, 2021

(30) Foreign Application Priority Data

Oct. 10, 2018 (EP) ..... 18290117

(51) Int. Cl.
*F24C 7/08* (2006.01)
*F24C 15/32* (2006.01)

(52) U.S. Cl.
CPC ..... *F24C 7/085* (2013.01); *F24C 15/322* (2013.01)

(58) Field of Classification Search
CPC ..... F24C 7/085; F24C 15/322
See application file for complete search history.

(56) References Cited

U.S. PATENT DOCUMENTS

2013/0302483 A1 11/2013 Riefenstein
2014/0208957 A1 7/2014 Imai
2015/0285513 A1* 10/2015 Matarazzi ..... F24C 15/00 99/342
2015/0366219 A1 12/2015 Stork Genannt Wersborg
2016/0327279 A1* 11/2016 Bhogal ..... A47J 36/321
2017/0074522 A1 3/2017 Cheng
2018/0152995 A1 5/2018 Hirohisa
2018/0184668 A1 7/2018 Stork Genannt Wersborg
(Continued)

FOREIGN PATENT DOCUMENTS

DE 102015107228 A1 11/2016
DE 102017101183 A1 7/2018
(Continued)

OTHER PUBLICATIONS

International Search Report PCT/EP2019/077164 dated Dec. 2, 2019.
Report of Examination EP19780263.0 dated Feb. 15, 2024.

*Primary Examiner* — Thien S Tran
(74) *Attorney, Agent, or Firm* — Michael E. Tschupp; Andre Pallapies; Brandon G. Braun

(57) ABSTRACT

In a method for preparing a cooking product, an image is captured of a cooking product by a camera, and a virtual image of the cooking product is provided to show a cooking state of the cooking product as captured by the image at a later cooking time.

15 Claims, 4 Drawing Sheets

(56) References Cited

U.S. PATENT DOCUMENTS

| | | | | |
|---|---|---|---|---|
| 2018/0292092 | A1* | 10/2018 | Bhogal | F24C 7/087 |
| 2018/0372326 | A1 | 12/2018 | Hyeong | |
| 2019/0128531 | A1* | 5/2019 | Abdoo | F27D 21/0014 |

FOREIGN PATENT DOCUMENTS

| | | | |
|---|---|---|---|
| EP | 1980791 | A2 | 10/2008 |
| JP | H1145297 | A | 2/1999 |

* cited by examiner

METHOD FOR PREPARING A COOKING PRODUCT, COOKING DEVICE, AND COOKING DEVICE SYSTEM

CROSS-REFERENCES TO RELATED APPLICATIONS

This application is the U.S. National Stage of International Application No. PCT/EP2019/077164, filed Oct. 8, 2018, which designated the United States and has been published as International Publication No. WO 2020/074478 A1 and which claims the priority of European Patent Application, Serial No. 18290117.3, filed Oct. 10, 2018, pursuant to 35 U.S.C. 119(a)-(d).

BACKGROUND OF THE INVENTION

The invention relates to a method for preparing a cooking product, wherein an image of a cooking product is captured by means of a camera. The invention also relates to a cooking appliance with a cooking chamber and a camera directed into the cooking chamber, the cooking appliance being designed to perform the method. The invention also relates to a cooking appliance system, having a cooking appliance with a cooking chamber and a camera directed into the cooking chamber as well as a data processing facility coupled to the cooking appliance by way of a data network, the cooking appliance being designed to transmit images captured by the camera to the data processing facility. The invention further relates to a cooking appliance system, having a cooking appliance and at least one camera for capturing a cooking product to be cooked by the cooking appliance, the cooking appliance being designed to transmit images captured by the camera to the data processing facility. The invention can in particular be applied advantageously to the preparation of a cooking product in an oven. The cooking appliance is in particular a household appliance.

DE 10 2015 107 228 A1 discloses a method for controlling at least one subprocess of at least one cooking process in a cooking appliance. Relevant data for at least one subprocess of a cooking process is acquired, in particular details of the cooking product to be cooked as well as target parameters. The data is sent to a simulation model. The simulation model simulates the at least one subprocess, by means of which a data of the cooking product to be cooked desired by the user is achieved. The process data of relevance to the execution of the cooking process is sent to a cooking appliance.

EP 1 980 791 A2 discloses a cooking appliance with a browning sensor apparatus and an electronic unit. It is proposed that at least one degree of browning of a cooking product can be supplied to an output unit by means of the electronic unit for outputting to an operator. This allows for example the remaining cooking time to be calculated, it also being possible to take into account the insertion level of the cooking product, in other words the distance between cooking product and heating element.

BRIEF SUMMARY OF THE INVENTION

It is the object of the present invention to overcome the disadvantages of the prior art at least partially and in particular to improve the ability of a user to select a desired cooking result.

This object is achieved according to the features of the independent claims. Advantageous embodiments are set out in the dependent claims, the description, and the drawings.

The object is achieved by a method for preparing a cooking product, wherein an image of a cooking product is captured by means of a camera and at least one virtual image of the cooking product is provided, showing a cooking state of the previously captured cooking product at a later cooking time.

This has the advantage that a user can see at least an approximation of a state of a cooking product at future times by looking at the at least one virtual image. This in turn advantageously allows said user to visually select in their opinion the best state of the cooking product and tailor a cooking sequence thereto. This in turn allows a particularly high level of user convenience to be achieved when preparing a cooking product.

A camera can refer to any image capturing facility which is designed to capture a ("real") image of the cooking product. The camera is sensitive in the spectral range that is visible to humans, in particular only sensitive in the visible spectral range (in other words not a (purely) IR camera).

A "virtual" image refers to an image that does not correspond to the image captured by the camera per se. A virtual image can be for example an image derived or modified from the captured image by image processing, an image of a cooking product (but not the very cooking product captured by the camera) retrieved from a database, etc.

Providing the virtual image in particular includes the option of displaying the at least one virtual image on a screen. The screen can be a screen of a cooking appliance, in particular the one being used to prepare the cooking product, and/or a screen of a user terminal such as a smartphone, tablet, laptop PC, desktop PC, etc. The screen is in particular a touch-sensitive screen so that a displayed virtual image can be actuated to select it, for example to initiate at least one action associated with said virtual image.

In one development a number of virtual images are provided for a user to view, the virtual images corresponding in particular to different values of at least one cooking parameter, for example a cooking time and/or cooking temperature. In other words a number of images can be provided for a user to view, showing a different cooking story. The user can select a virtual image to have its cooking parameters displayed and/or to transfer at least some of the modifiable or variable cooking parameters to a cooking appliance, as set out in more detail below.

In one development the above method can be initiated or started by a user, for example by actuating a corresponding actuation field on a cooking appliance or on a user terminal (for example by way of a corresponding application program). In one development the user can start the method at any time, in particular before or during a cooking operation or cooking sequence. The real image captured by the camera can therefore be captured before the start of a cooking sequence and/or during a cooking sequence. A number of real images can also be captured at different times.

In one embodiment the at least one virtual image is provided for selection by a user (for example of a cooking appliance preparing the cooking product) and on selection of a virtual image at least one cooking parameter for the cooking appliance is provided, which results in a cooking state corresponding to the cooking state of the cooking product in the selected virtual image. This has the advantage that a user can search for or select a desired future state or end state of the cooking product based on a virtual image and the selection then allows at least one cooking parameter to be set at least partially automatically at the cooking appliance processing the cooking product so that the cooking state matching the selected virtual image is at least approximately achieved. In particular the cooking state matching the selected virtual image is achieved at the end of a cooking sequence or at the end of a specific phase or segment of the cooking sequence. In other words the cooking sequence or a segment thereof can be ended when the cooking state matching the selected virtual image is achieved. Alternatively or additionally at least one other action can then be initiated, for example a user notification.

In one embodiment the at least one cooking parameter associated with the selected virtual image is acquired automatically by the cooking appliance on selection of the virtual image. This gives a user particularly convenient control of a cooking sequence, in particular allowing a desired cooking state of a cooking product to be achieved accurately.

In one embodiment the at least one cooking parameter comprises at least one cooking parameter from the set

- remaining cooking time;
- cooking temperature;
- cooking mode (e.g. bottom heat, top heat, grill mode, hot air, etc.);
- degree of humidity;
- circulating air fan speed;
- microwave power;
- heat setting.

The cooking temperature can comprise for example a cooking chamber temperature of a cooking chamber, a core temperature of a cooking product and/or a temperature of cookware (for example a pot, frying pan, roasting pan, etc.).

The cooking parameters available on a specific cooking appliance can vary. In a simple oven only the cooking parameters remaining cooking time, cooking chamber temperature and cooking mode may be available; in an oven with steam generation function there will also be the cooking parameter degree of humidity; in a cooking appliance configured to operate with a core temperature sensor there will also be the cooking parameter core temperature, etc. If the cooking appliance has a microwave functionality (e.g. a standalone microwave oven or an oven with microwave functionality) the cooking parameter microwave power may be available for example. In the case of a cooktop the power level associated with a hotplate and/or a cookware temperature and/or a cooking product temperature can also be available for example.

In one embodiment at least one cooking parameter can be preset by the user. This allows those cooking parameters required for the successful and/or fast preparation of a cooking product to be preset by the user to provide the at least one virtual image. Selection of the virtual image then in particular allows at least one cooking parameter, which can still be freely selected or varied, to be provided for a user or be automatically acquired.

In one example a user of an oven can permanently preset a desired operating mode and cooking temperature but select a remaining cooking time by selecting a virtual image. The camera can be integrated in the oven and/or arranged outside the oven and then be directed into the cooking chamber through a viewing window in a cooking chamber door.

In another example a user of an oven can permanently preset a desired operating mode and remaining cooking time but select a cooking temperature by selecting a virtual image.

In yet another example a user of an oven with steam cooking function can preset a desired operating mode, cooking temperature and cooking chamber humidity but select a remaining cooking time by selecting a virtual image.

In yet another example a user of an oven can preset a desired operating mode and cooking temperature but select a target core temperature by selecting a virtual image.

In yet another example a user of a cooktop can preset a desired power level of a specific hotplate but select a remaining cooking time by selecting a virtual image. In this instance the camera can be integrated for example in a flue or extractor hood.

In one development a user inputs the nature of the cooking product (comprising for example a type of the at least one cooking product, a mode of preparation, etc.) before the at least one virtual image starts to be provided, for example by way of a user interface of a cooking appliance or user terminal. This allows virtual images to be provided which show an approximation of the cooking state of the cooking product particularly precisely.

In one embodiment identification of the cooking product shown in the captured image is automatically performed using the captured real image, for example using object recognition. This is a particularly convenient way of determining the nature of the cooking product processed or to be processed. In one development a user can check and optionally change or correct the details relating to the cooking product as recognized by the automatic identification of the cooking product.

In one embodiment the at least one virtual image is provided for selection, on selection of a virtual image further images are captured by means of the camera and at least one action is initiated when an image captured by means of the camera corresponds to the selected virtual image, optionally within a predefined similarity range. This has the advantage that the camera can also be used as an optical state sensor. The similarity range corresponds in particular to a bandwidth or target corridor assigned to the selected virtual image. The similarity range can be permanently preset or can be changed or set by a user. The at least one action can comprise outputting a, for example, acoustic and/or visual notification to a user (optionally including outputting a message to the user) and/or ending the cooking sequence or a cooking phase or a cooking segment thereof. The image comparison can be performed by means of a data processing facility, which is part of the cooking appliance or which is provided by an external agency coupled to the camera for data purposes, for example by means of a network server or what is known as the cloud (cloud-based data processing facility).

In one embodiment at least one action is initiated when a degree of browning in an image captured by means of the camera corresponds to a degree of browning in the selected virtual image, optionally within a predetermined similarity range. This has the advantage that the camera can also be used as an optical browning sensor. The at least one action can be initiated when the degree of browning of the real cooking product reaches the degree of browning of the cooking product shown in the virtual image or a bandwidth of the degree of browning of the cooking product shown in the virtual image.

In addition or as an alternative to the degree of browning other states or state changes of the cooking product can be monitored, for example a volume and/or shape of the cooking product (useful for preparing soufflés, bread dough, etc.), its texture, etc.

It is generally possible to use the selection of a virtual image to set at least one cooking parameter and/or to control a cooking sequence or just a specific cooking segment or cooking phase thereof. Possible cooking segments or cooking phases can relate for example to the rising of dough (e.g. bread dough), drying of the cooking product and/or browning.

In one embodiment the at least one virtual image is calculated from the real image captured by means of the camera. This has the advantage that the cooking product captured in the real image is reproduced particularly similarly in the at least one virtual image, for example in respect of specific shape, color and/or arrangement of the cooking product. This in turn helps a user to track the progress of the cooking of the cooking product in the at least one virtual image particularly easily. The calculation can be performed by means of an appropriately set up (e.g. programmed) data processing facility. This can be the data processing facility that is also used to perform the image comparison.

The virtual image can be calculated or derived from the real image such that colors of the cooking product shown in the real image or of different cooking products shown in the real image are matched to cooking progress. Therefore in the virtual image a degree of browning of the cooking product or the cooking products can be adjusted to a future cooking time instant. Alternatively or additionally the virtual image can be calculated or derived from the real image such that a change in the shape of the cooking product is calculated.

Calculation of the virtual images can be performed based on appropriate algorithms. In one development these algorithms can draw on characteristic curves that are specific to cooking products and a function of cooking parameters. Alternatively or additionally the algorithms can operate or run in the manner of neural networks, in particular using what is known as deep learning. In one development the algorithms can use the real images to adapt or change for a specific user or use group in a self-learning manner.

In an additional or alternative embodiment the at least one virtual image is determined from an image stored in a database, in particular corresponds to an image stored in a database. This advantageously dispenses with the need for object processing of a cooking product recognized in the real image, thereby reducing computation outlay. The images stored in a database can also be referred to as reference images. The reference images can be captured before or separately from the above method by means of a camera, for example by a cooking product producer, a cooking studio, a user, etc. For example if a roast chicken is identified in the real image captured as part of the method or is given as the cooking product by a user, the virtual images can correspond to reference images showing a reference roast chicken roasted using the same or similar preset cooking parameters and captured at different cooking times.

In one embodiment the later cooking time can be set by the user. This has the advantage that a user can look at a virtual image of the cooking product shown, in particular recognized, in the real image at a later cooking time determined by said user. If therefore a user wants to see how the cooking product will probably look in five minutes, said user can preset "5 minutes" as the later cooking time and will then be shown a corresponding virtual image. The user can then initiate at least one action (e.g. set the five minutes as the remaining cooking time) but does not have to. A user can also set time steps for multiple virtual images.

In one embodiment the image captured by the camera and the at least one virtual image show the cooking product from the same viewing angle. This advantageously facilitates an image comparison.

In an alternative or additional embodiment the image captured by the camera and the at least one virtual image show the cooking product from a different viewing angle. This has the advantage that a user can have different views of the cooking product. The views at different viewing angles can be calculated and/or provided from reference images.

The object is also achieved by a cooking appliance with a cooking chamber and at least one camera directed into the cooking chamber, the cooking appliance being designed to perform the method as described above. The cooking appliance can be configured analogously to the method and has the same advantages.

In one embodiment the cooking appliance is an oven, cooker, microwave appliance, steam cooker or any combination thereof, for example an oven with microwave and/or steam generation functionality.

In one development the fact that the cooking appliance is designed to perform the method as described above can mean that the cooking appliance is designed to perform the method autonomously. The cooking appliance has a corresponding data processing facility for this purpose.

The object is also achieved by a cooking appliance system, having a cooking appliance with a cooking chamber and a camera directed into the cooking chamber, as well as a data processing facility coupled to the cooking appliance by way of a data network (e.g. cloud-based), the cooking appliance being designed to transmit images captured by the camera to the data processing facility and the data processing facility being designed to provide at least one virtual image of the cooking product, showing a cooking state of the previously captured cooking product at a later cooking time, and to transmit it to the cooking appliance. The cooking appliance system can be configured analogously to the method and has the same advantages.

The cooking appliance can be fitted with a communication module, such as a WLAN module, Bluetooth module and/or Ethernet module or the like, for coupling for data purposes by way of the data network.

The object is also achieved by a cooking appliance system, having a cooking appliance and at least one camera for capturing a cooking product to be cooked by the cooking appliance, the cooking appliance being designed to transmit images captured by the camera to the data processing facility and the data processing facility being designed to provide at least one virtual image of the cooking product, showing a cooking state of the previously captured cooking product at a later cooking time, and to transmit it to the cooking appliance. The cooking appliance system can be configured analogously to the method and has the same advantages.

This cooking appliance system has the advantage that it can also be applied to cooking appliances that do not have a closable cooking chamber and in some instances also do not have their own camera, for example cooktops. The camera can therefore be integrated in the cooking appliance or can be a standalone camera. One possible example of such a cooking appliance system comprises a cooktop and a flue or extractor hood, it being possible for the camera to be arranged on the extractor hood. The camera is directed onto the cooktop or the cooktop is located in the field of view of the camera. The camera can then capture a real image of a cooking product cooking in a pan, pot or the like and provide corresponding virtual images.

The virtual images can generally be provided, viewed, and/or selected at the cooking appliance and/or on a correspondingly embodied (e.g. programmed) user terminal.

The cooking appliances described above are in particular household appliances.

BRIEF DESCRIPTION OF THE DRAWINGS

The properties, features and advantages of the present invention described above as well as the manner in which these are achieved will become clearer and more easily comprehensible in conjunction with the following schematic description of an exemplary embodiment described in more detail in conjunction with the drawings.

DETAILED DESCRIPTION OF EXEMPLARY EMBODIMENTS OF THE PRESENT INVENTION

Figure 1:
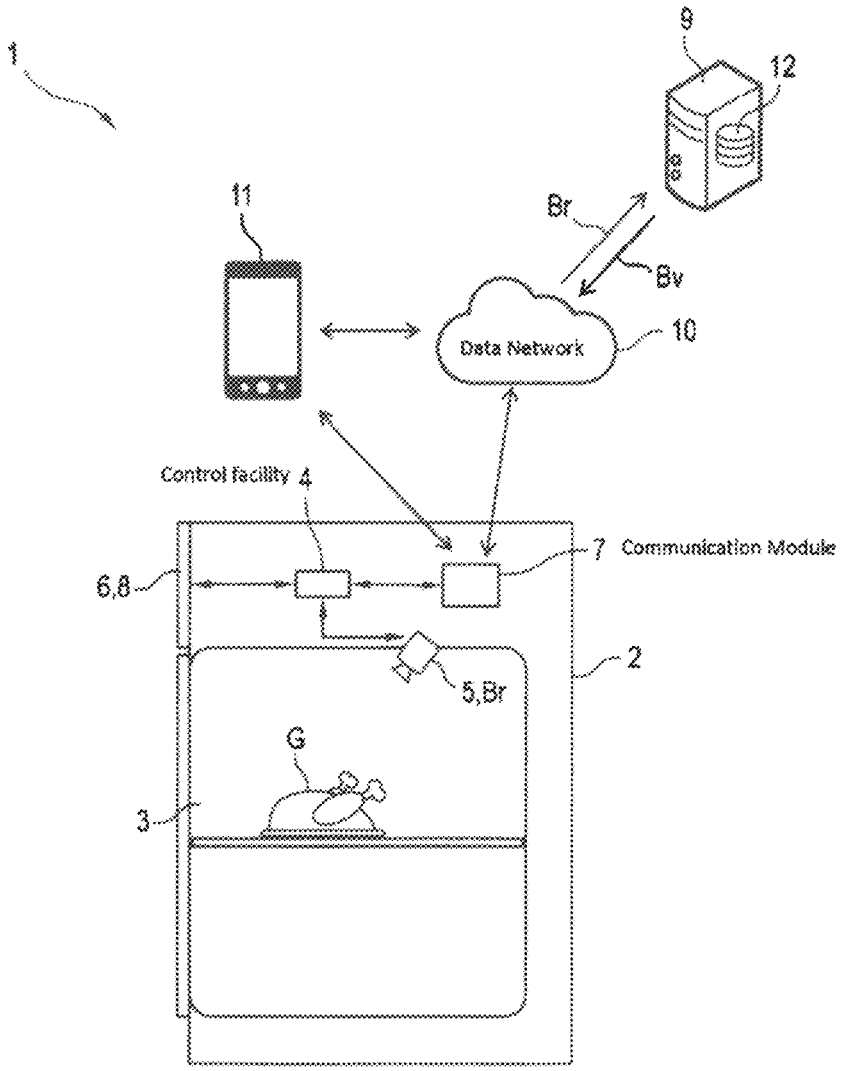
FIG. 1 shows an outline of a household cooking appliance system.

FIG. 1 shows an outline of a cooking appliance system 1 with an oven 2 as the cooking appliance. The oven 2 has a cooking chamber 3, in which a cooking product G (one or more cooking products or foods) can be processed. In one development the oven 2 can also have a microwave functionality and/or steam generation functionality in addition to its conventional heating modes (top heat, bottom heat, grill, hot air, circulating air, etc.) for the cooking chamber 3. Operation of the oven 2 can be controlled by means of a control facility 4, which is also connected for data purposes to a camera 5 directed into the cooking chamber 3, a user interface 6 and at least one communication module 7.

The camera 5 can be used to capture real images Br of a cooking product G present in the cooking chamber 3. The camera 5 is a digital camera in particular. The camera 5 is a color camera in particular. The real images Br are transmitted from the camera 5 to the control facility 4. In one development they can be forwarded by the control facility 4 to an in particular touch-sensitive screen 8 of the user interface 6 for viewing. The user interface 6 also serves to receive user settings and forward them to the control facility 4. In particular a user can also set desired cooking parameters for a cooking sequence or segment thereof by way of the user interface 6 and input the required assumptions or information for providing at least one virtual image Bv.

The at least one communication module 7 allows the oven 2 to be coupled for data purposes to an external data processing facility 9, for example by way of a data network 10. The communication module 7 can be a WLAN module for example. As indicated the data processing facility 9 can be located in a server (not shown) or can be cloud-based. The owner of the data processing facility 9 can be the producer of the oven 2.

The at least one communication module 7 also allows the oven 2 to be coupled for data purposes to a user terminal 11, in particular a mobile user terminal, for example a smartphone. This coupling for data purposes can also be established by way of the data network 10, for example by means of the WLAN module. However the communication nodule 6 can also be designed for direct coupling for data purposes to the user terminal 11, for example as a Bluetooth module. This allows remote control of the oven 2 by way of the user terminal 11. In particular a user can also set the desired cooking parameters for a cooking sequence or a segment thereof at the user terminal 11 and input the required assumptions or information for providing at least one virtual image Bv.

The user terminal 11 can be connected to the data processing facility 9 by way of the data network 10, for example by allowing a corresponding application program to run on the user terminal 11.

The oven 2 is designed in particular to transmit or send the real images Br captured by the camera 5 to the data processing facility 9. It can also be designed to transmit the real images Br captured by the camera 5 to the user terminal 11.

The data processing facility 9 is designed to provide at least one virtual image Bv of the cooking product G, showing a cooking state of the previously captured cooking product G at a later cooking time than the time of capture of the real image Br, and transmit it to the oven 2 and/or the user terminal 11.

Figure 2:
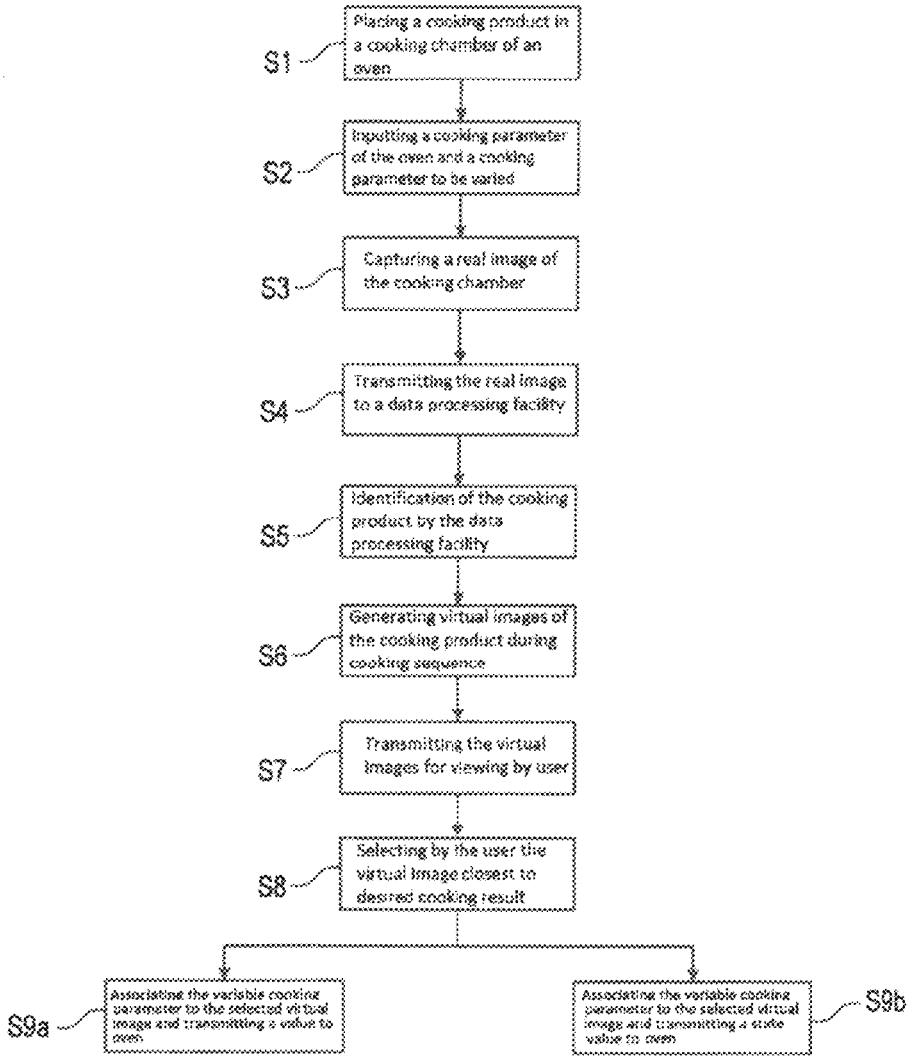
FIG. 2 shows a possible sequence of the method on the household cooking appliance system.

FIG. 2 shows a possible sequence of the method for preparing a cooking product G on the household cooking appliance system 1.

In a step S1 a user has placed the cooking product G in the cooking chamber 3, set cooking parameters at the oven 2 and then activates the method. Said user can activate the method by way of the touch-sensitive screen 8 of the user interface 6 and/or by way of the user terminal 11.

In a step S2 the user inputs at least one permanently preset cooking parameter of the oven 2 and at least one cooking parameter to be varied at the touch-sensitive screen 8 of the user interface 6 or by way of the user terminal 11 (for example by way of a corresponding application program or app). For example the user can preset a cooking mode and a cooking chamber temperature of the oven 2 and set the cooking time as variable. Alternatively the user can set the permanently preset cooking parameters at the oven 2. In another alternative the user only selects the at least one cooking parameter to be varied.

In a step S3 the camera 5 captures a real image Br of the cooking chamber 3, in which the cooking product G is shown.

In a step S4 the real image Br is transmitted from the oven 2 to the data processing facility 9.

In a step S5 the data processing facility identifies the cooking product G shown in the real image Br, for example using object recognition.

In a step S6 the data processing facility 9 generates virtual images Bv. In the virtual images Bv the image of the cooking product G has been processed to reproduce or simulate the cooking product G for different values of the cooking parameter to be varied, here for example in relation to the cooking time. In practice an image sequence of virtual images Bv of the cooking product G in particular can be produced, simulating, or reproducing the state of the cooking product G as the cooking time progresses. For example twelve virtual images Bv can be generated, each corresponding to cooking time progress of five minutes. A user can input a number of virtual images Bv, a time gap between successive virtual images Bv and/or a maximum value for the cooking time, for example in step S2.

In a step S7 the virtual images Bv are transmitted from the data processing facility 9 to the user terminal 11 and/or to the touch-sensitive screen 8 of the oven to be viewed by a user.

In a step S8 the user can look at the virtual images Bv and select the virtual image Bv (for example by touching the touch-sensitive screen 8) that is closest to the desired cooking result, for example in relation to degree of browning. On selection of the virtual image Bv at least one cooking parameter that results in a cooking state that corresponds to the cooking state of the cooking product G in the selected virtual image Bv is provided for the oven.

In a step S9*a* on selection of the virtual image Bv the associated value of the variable cooking parameter (in this instance cooking time) is transmitted to the oven 2 either automatically or after user initiation or is acquired by the oven 2 with the result that said oven 2 is set for this cooking time. When said cooking time is reached, at least one action is initiated, for example the cooking sequence or a specific cooking phase is ended.

In an alternative step S9*b* on selection of the virtual image Bv a state value (in this instance a degree of browning) of the cooking product G shown in the selected virtual image Bv of the variable cooking parameter is transmitted to the oven 2 or acquired by the oven 2. The oven 2 can then use the camera 5—in particular at regular intervals—to capture real images Br of the cooking product G in the cooking chamber 3 and monitor the cooking product G for its degree of browning. When the desired degree of browning is achieved (at least within a similarity range, not necessarily exactly) at least one action is initiated, for example the cooking sequence or a specific cooking phase is ended.

Alternatively an image comparison can be performed between the real images Br and the selected virtual image Bv to determine the degree of browning. The image comparison can be undertaken for example by the control unit 4 and/or by the data processing facility 9.

Generally the image Br captured by the camera 5 and the at least one virtual image Bv can show the cooking product G from a different viewing angle.

Alternatively or additionally in step S6 the virtual images Bv can be reference images stored in a database 12 coupled to the data processing facility 9 or integrated in the data processing facility 9.

Figure 3:
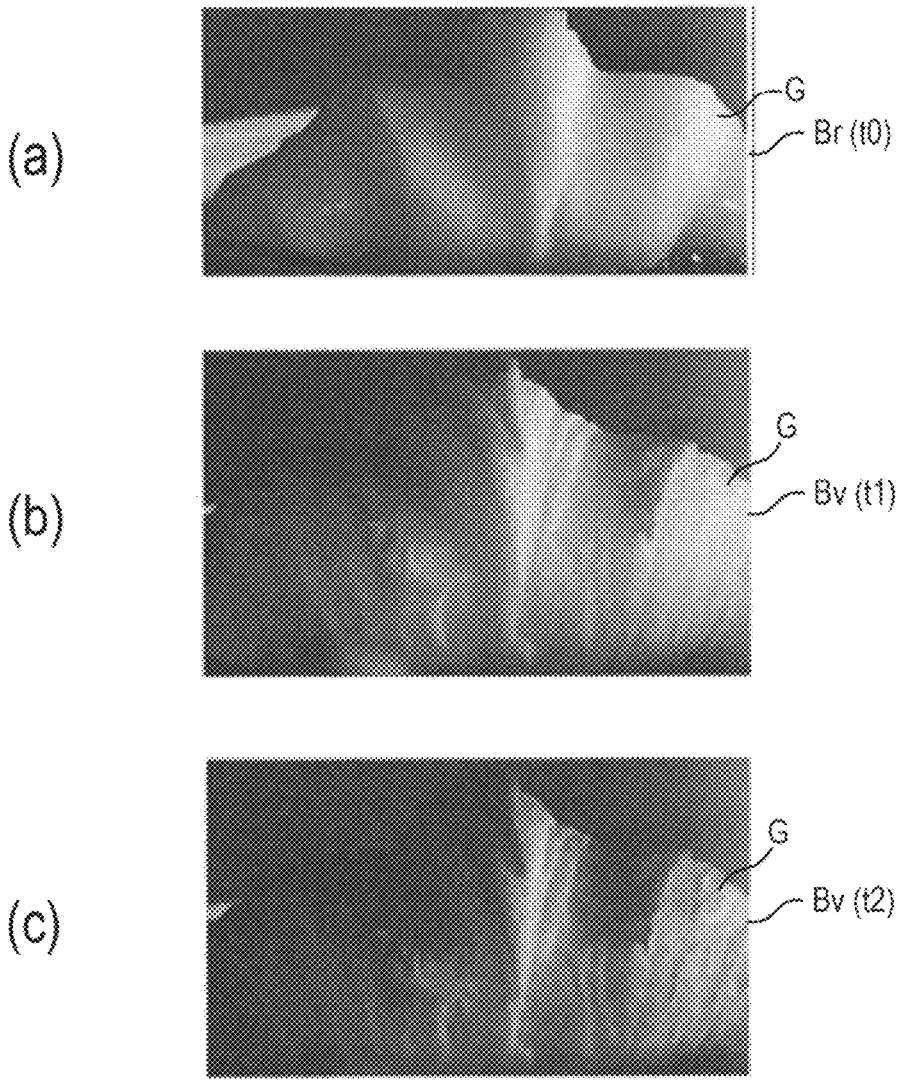
FIG. 3 shows a real image and two virtual images determined therefrom.

FIG. 3 shows a real image Br (t0) captured at a time t0, a virtual image Bv (t1) of a cooking product G determined for a subsequent time t1 where t1>t0 and a virtual image Bv (t2) determined for a subsequent time t2 where t2>t1. For example it is possible that t2=t1+30 mins and t1=t0+30 mins. The associated cooking product G here is shown as a leaf vegetable.

The virtual images Bv (t1) and Bv (t2) are calculated for example from the real image Br (t0) using an algorithm. The algorithm is configured to adjust a degree of browning, a shape and/or a texture of the cooking product G shown in the real image Br (t0) for times t1 and t2 with preset cooking parameters such as cooking chamber temperature and cooking mode.

Alternatively the images displayed can all be images retrieved from a database 12, showing the cooking product G corresponding to a type of cooking product identified in a previously captured real image (not shown) or specified by a user.

Figure 4:
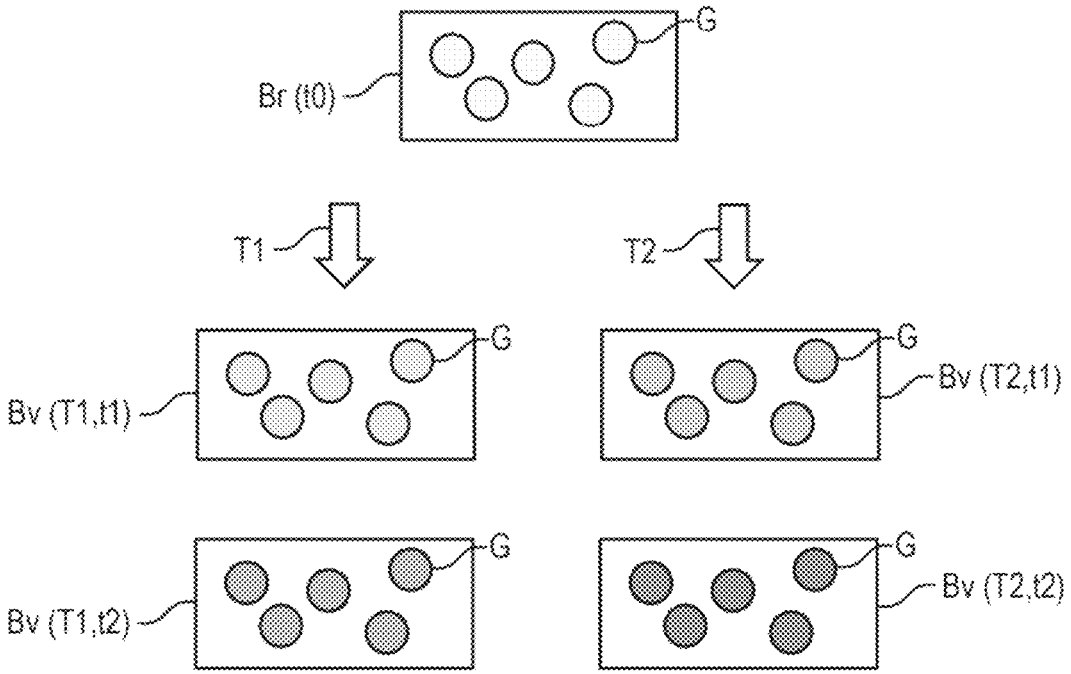
FIG. 4 shows an outline of a further real image and virtual images determined therefrom.

FIG. 4 shows an outline of a further real image Bv (t0) and virtual images Bv (T1, t1) and Bv (T1, t2) determined therefrom for a cooking chamber temperature T1 and virtual images Bv (T2, t1) and Bv (T2, t2) determined for a cooking chamber temperature T2. The cooking chamber temperature and cooking time here are therefore variable cooking parameters, which have been selected to be varied in particular by the user. Again t0<t1<t2. Also T1<T2, for example where T1=100° C. and T2=180° C.

The virtual images Bv show different degrees of browning as a function of the cooking chamber temperatures T1, T2 and cooking times t1, t2 selected by the user. A user can select one image Bv from the virtual images Bv and the degree of browning shown therein is acquired for the oven 2 as the target or target value for the real cooking product. The camera 5 can then be used as an optical browning sensor to end for example the cooking sequence or an associated browning phase when the degree of browning of the real cooking product G achieves the degree of browning (in particular within a similarity band or range) shown in the selected virtual image.

The present invention is of course not limited to the exemplary embodiment shown.

Generally "one" can be understood to imply one or a number, in particular in the sense of "at least one" or "one or more", etc., unless specifically excluded, for example in the expression "just one", etc.

The invention claimed is:

1. A method for preparing a cooking product, said method comprising:

capturing an image of a cooking product by a camera;

in response to a user selecting a fixed quantitative cooking parameter, providing one or more virtual images of the cooking product for selection by a user, wherein each virtual image is configured to show a cooking state of the cooking product at a later cooking time, and wherein each virtual image corresponds to the fixed quantitative cooking parameter and to a unique value of a variable cooking parameter; and in response to a user selecting a virtual image of the one or more virtual images, providing the fixed quantitative cooking parameter and the unique value of the variable cooking parameter corresponding to the virtual image to a cooking appliance which produces a cooking state corresponding to the cooking state of the cooking product shown by the selected virtual image.

2. The method of claim 1, wherein the variable cooking parameter associated with the selected one of the virtual images is acquired automatically by the cooking appliance on selection of the virtual image.

3. The method of claim 1, wherein the variable cooking parameter is at least one cooking parameter selected from the group consisting of remaining cooking time, cooking temperature, cooking mode, humidity, and circulating air fan speed.

4. The method of claim 3, wherein the cooking mode includes bottom heat, top heat, grill mode, and hot air.

5. The method of claim 1, further comprising enabling a user to preset or vary the fixed quantitative cooking parameter.

6. The method of claim 1, further comprising identifying the cooking product shown in the captured image by using the captured image.

7. The method of claim 1, further comprising:

capturing further images by the camera after selecting a virtual image of the one or more virtual images; and initiating an action when an image of the further images captured by the camera corresponds to the selected one of the virtual images within a predefined similarity range.

8. The method of claim 7, wherein the action is initiated, when a degree of browning in the image captured by the camera corresponds to a degree of browning in the selected one of the virtual images within the predefined similarity range.

9. The method of claim 1, further comprising calculating the virtual image from the image captured by the camera.

10. The method of claim 1, further comprising setting the later cooking time by a user.

11. The method of claim 1, wherein the image captured by the camera and the virtual image show the cooking product from a different viewing angle.

12. A cooking appliance configured to perform a method as set forth in claim 1, said cooking appliance comprising:

a cooking chamber for accommodating a cooking product;

a camera directed into the cooking chamber to capture an image of the cooking product; and a data processing facility configured to provide one or more virtual images of the cooking product for selection by a user in response to the user selecting the fixed quantitative cooking parameter, wherein each virtual image is configured to show a cooking state of the captured cooking product at a later cooking time.

13. A cooking appliance system, comprising:

a cooking appliance including a cooking chamber and a camera directed into the cooking chamber; and a data processing facility coupled to the cooking appliance by way of a data network, said cooking appliance being designed to transmit images captured by the camera to the data processing facility, said data processing facility being configured to provide one or more virtual images of a cooking product for selection by a user in response to a user selecting a fixed quantitative cooking parameter, wherein each virtual image is configured to show a cooking state of the captured cooking product at a later cooking time, and to transmit the virtual image to the cooking appliance, wherein each virtual image corresponds to the fixed quantitative cooking parameter and to a unique value of a variable cooking parameter;

wherein, upon selection of the one or more virtual images of the cooking product by the user, the data processing facility is configured to transmit the preset quantitative cooking parameter and the unique value of the variable cooking parameter corresponding to the selected virtual image to the cooking appliance such that the cooking appliance produces a cooking state corresponding to the cooking state of the cooking product shown by the selected virtual image.

14. A cooking appliance system, comprising:

a cooking appliance;

a camera for capturing a cooking product to be cooked by the cooking appliance; and a data processing facility, wherein the cooking appliance is designed to transmit images captured by the camera to the data processing facility, and wherein the data processing facility is configured to provide one or more virtual images of the cooking product for selection by a user in response to a user selecting a preset quantitative cooking parameter and a variable cooking parameter, wherein each virtual image is configured to show a cooking state of the captured cooking product corresponding to a unique value of the variable cooking parameter, and to transmit the virtual image to the cooking appliance; and wherein, upon selection of the one or more virtual images of the cooking product by the user, the data processing facility is configured to transmit the preset quantitative cooking parameter and the unique value of the variable cooking parameter corresponding to the selected virtual image to the cooking appliance such that the cooking appliance produces a cooking state corresponding to the cooking state of the cooking product shown by the selected virtual image.

15. The method of claim 1, wherein the fixed quantitative cooking parameter comprises time, and wherein the variable cooking parameter comprises temperature.

* * * * *